US009950509B2

(12) United States Patent
Cheng

(10) Patent No.: US 9,950,509 B2
(45) Date of Patent: Apr. 24, 2018

(54) BAFFLED INK CUP

(71) Applicant: James Cheng, Poway, CA (US)

(72) Inventor: James Cheng, Poway, CA (US)

( * ) Notice: Subject to any disclaimer, the term of this patent is extended or adjusted under 35 U.S.C. 154(b) by 0 days.

(21) Appl. No.: 15/294,777

(22) Filed: Oct. 16, 2016

(65) Prior Publication Data

US 2017/0028708 A1 Feb. 2, 2017

Related U.S. Application Data

(63) Continuation-in-part of application No. 13/297,516, filed on Nov. 16, 2011.

(51) Int. Cl.
*B41F 17/00* (2006.01)
*B41F 31/02* (2006.01)

(52) U.S. Cl.
CPC ..... *B41F 31/02* (2013.01); *B41F 17/001* (2013.01)

(58) Field of Classification Search
CPC ..... B41F 17/001; B41F 31/02
See application file for complete search history.

(56) References Cited

U.S. PATENT DOCUMENTS 5,419,247 A * 5/1995 Bachmann ..... B41F 17/001 101/318
6,584,898 B2 * 7/2003 Reinholdt ..... B41F 17/001 101/163

* cited by examiner

*Primary Examiner* — Blake A Tankersley
*Assistant Examiner* — Leo T Hinze
(74) *Attorney, Agent, or Firm* — Steven W. Webb

(57) ABSTRACT

A modified ink cup for plate printing is presented, where the ink cup is separated internally into two domains, a storage area and a print area, by a baffle system. The baffling allows only a limited amount of exposure of the ink in the ink cup to the outside air, reducing evaporation of the ink solvent and extending the life of the ink supply in the cup. This system greatly reduces the number of times an ink cup has to be re-filled to perform plate printing and limits the evaporation of possibly toxic solvents to the air.

1 Claim, 2 Drawing Sheets

BAFFLED INK CUP

FIELD OF THE INVENTION

This invention relates to improvements in the printing process involving reduction of ink thinner needs due to evaporation and minimizing environmental damage from volatile solvents.

BACKGROUND OF THE INVENTION

Ink cups (also known as but not limited to reservoirs, chambers, vessels, cartridges ink wells, etc.) are used in pad printing and other applications to bring ink to the printing plate surface and the artwork image area. The ink cup moves, open side down, on the printing plate surface, distributing ink via convection to the image area. The liquid ink inside the cup is mixed with a volatile solvent, which evaporates at a predictable rate of speed.

In the present technology, the ink cup is a single chamber filled with ink. As the cup moves across the printing plate, convection forces fresh ink from the interior of the cup towards the opening over the plate surface, pushing older ink back up the cup, exposing all solvent dissolved ink to the print plate surface and thereby to the air, leading to maximum evaporation of solvent and requiring that the ink cup be frequently re-filled with ink solvent mixture.

The present technology increases the viscosity of the entire ink supply while the ink cup moves over the print plate. The ink quickly becomes too thick to print effectively and must be adjusted at short intervals.

A method of reducing the exposure of all the ink to the air and plate surface as it is being used is needed to minimize refilling of the ink cup and limit evaporation of high-Volatile Organic Compound (VOC) solvents to the air. The prior art reveals a collection of print cup technologies that do not address these requirements.

SUMMARY OF THE INVENTION

The present invention consists of a baffled ink cup that separates the ink cup into chambers: a storage chamber and an ink dispensing chamber. The dispensing chamber is in direct contact with the print plate and the storage chamber is separated from the dispensing chamber by means of a baffle plate. This arrangement minimizes contact between the entire ink supply and the print plate, which reduces evaporation of the solvent to the air.

The ink turbulence created by the motion of the ink cup across the print plate is limited to the dispensing chamber, reducing the disturbances to the storage chamber. Contact between the storage and dispensing chambers is limited to the openings in the baffle plate, and gradually refill the dispensing chamber from the storage chamber.

The baffle plate is held to the body of the ink cup by any means of attachment, in this case by strong magnets, so that the plate can be easily removed for refilling and cleaning. The baffle plate can also be attached by any other means available. The cup is made of aluminum, plastic or ceramic, the preferred mode being aluminum.

DETAILED SPECIFICATION

Figure 1:
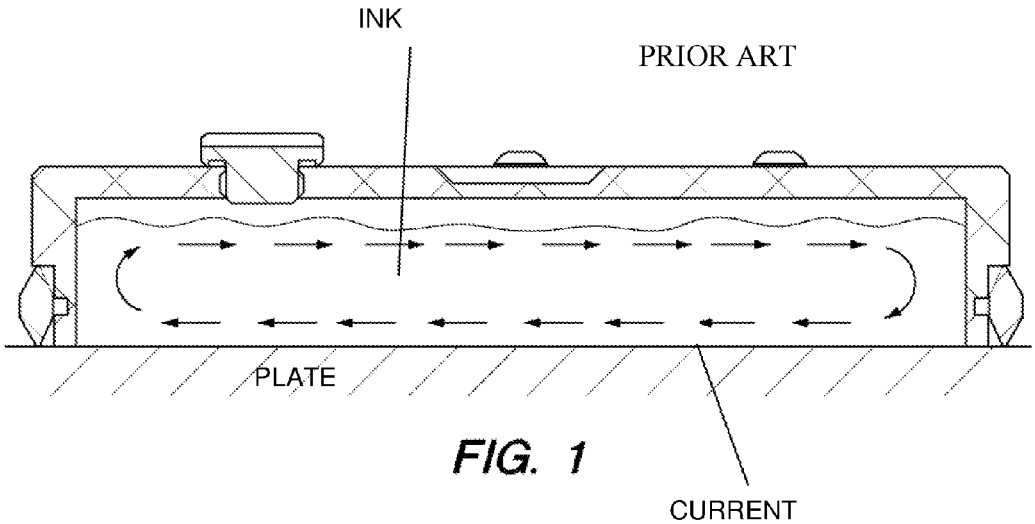
FIG. 1. Existing Ink Cup Technology

FIG. 1 illustrates the concept of existing ink cup technology, showing the convection current of ink flowing from the single ink reservoir down to the plate surface and back up into the body of the ink cup. The cup moves horizontally relative to the print plate, generating this current. The entire ink supply is thereby exposed to the print plate and the outside air.

Figure 2:
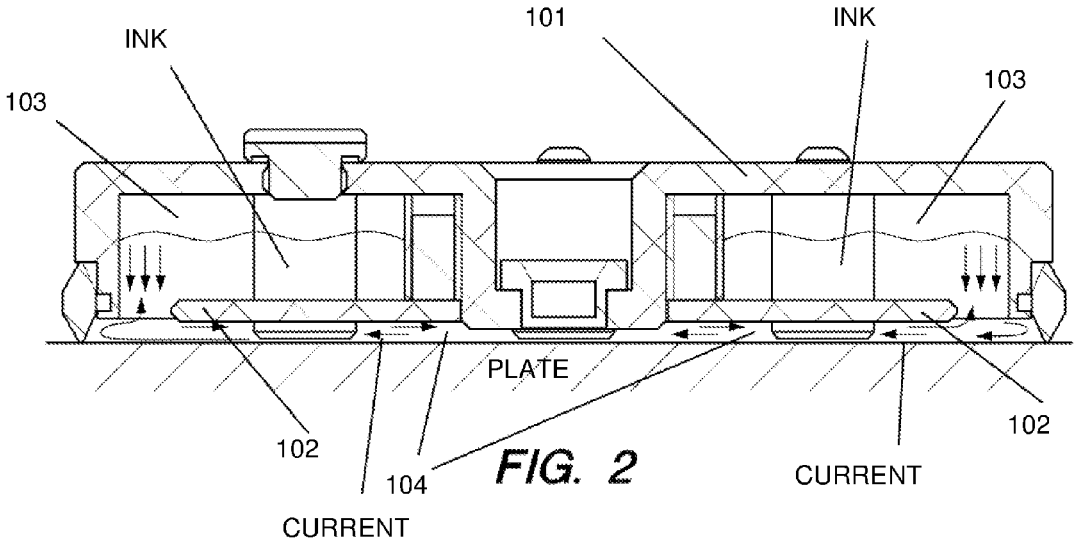
FIG. 2. Ink Flow and Cup Movement Using the New Technology

In FIG. 2, concept of the present invention is shown. There is a baffle plate 102 separating the ink cup 101 into two domains, a storage chamber 103 and an ink reservoir 104. The new ink reservoir 104 is much smaller in volume than the entire ink cup and permits a much smaller volume of ink plus solvent to be exposed to the outside air, reducing solvent evaporation. The same convection current is established by the cup's motion across the print plate, but the current does not reach into the upper ink storage chamber 103.

Figure 3:
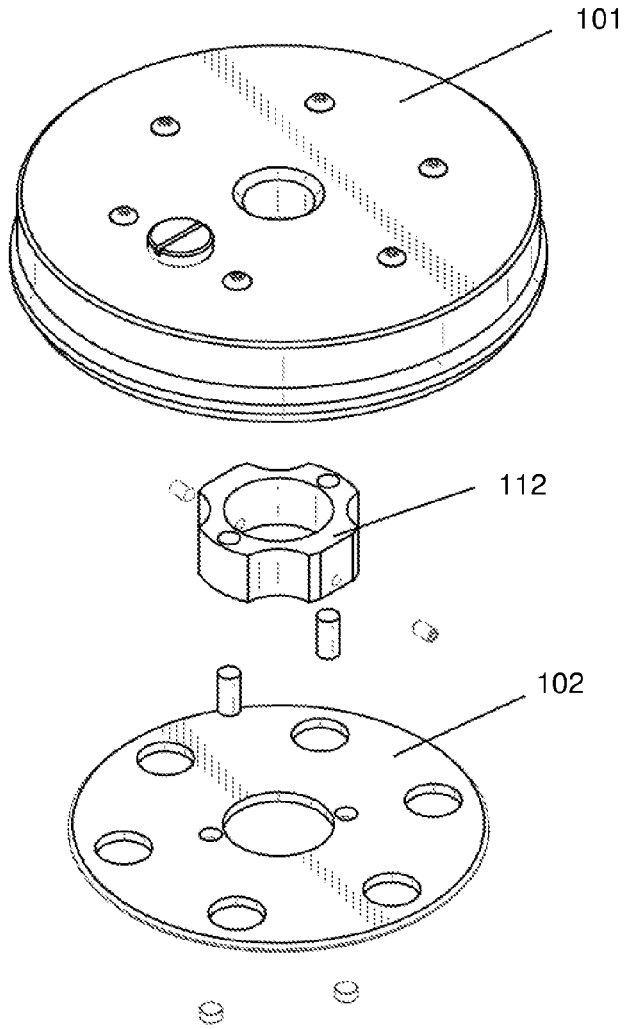
FIG. 3. Exploded Drawing of the Invention
Figure 4:
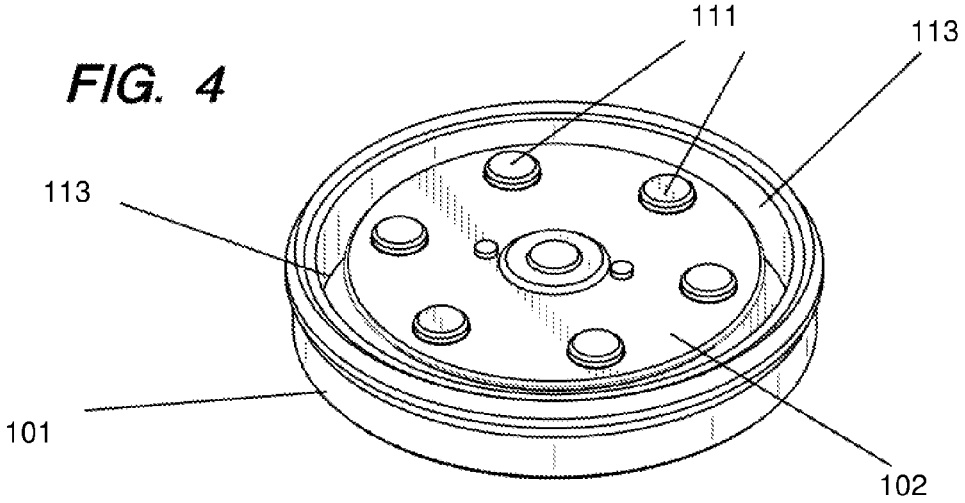
FIG. 4. Perspective View of the Bottom of the Assembled Cup

The baffle plate 102 is held onto the cup by means of a plurality of permanent magnets 111. FIG. 3 and FIG. 4 show several details of the preferred embodiment of the invention, including a baffle adapter 112 which maintains the separation between the baffle plate 102 and the ink cup 101, and a concentric, circular opening 113 near the ink cup rim for ink flow to the plate.

The ink cup 101 can be made of any rigid material, including but not limited to aluminum, ceramic, and plastic. Round or oval cup shapes are most effective. The preferred embodiment is a round, aluminum cup.

The baffling that minimizes contact between the ink supply and the print plate can consist of vertical baffles, rolling obstructions such as marbles or ball bearings (not illustrated), and horizontal baffles, which can be solid or porous. The preferred embodiment is a horizontal plate with a plurality of holes or a circular, concentric opening near the edges of the plate.

This invention has other applications, potentially, and one skilled in the art could discover these. The explication of the features of this invention does not limit the claims of this application; other applications developed by those skilled in the art will be included in this invention.

What is claimed is:

1. A baffled ink cup, the baffled ink cup comprised of an ink cup and a baffle plate, the ink cup a flat, cylindrical, hollow structure with an open face, the ink cup placed open-face down on a print plate, the ink cup possessing no moving parts, the baffle plate a flat structure separating the ink cup into a first domain and a second domain, the first domain a storage chamber, the second domain an ink reservoir, the ink reservoir smaller in volume than the entire ink cup and the storage chamber, the ink reservoir formed by the baffle plate above it and the print plate below it, the ink reservoir connected to the storage chamber through the baffle plate by means of one or more ink access openings, the baffle plate held onto the ink cup removably with a plate attachment means, the ink cup and baffle plate are made of any rigid material, the ink cup is in a round cylinder shape, comprised of steel, the baffle plate is comprised of steel, the plate attachment means is a plurality of magnets holding the baffle plate to the ink cup, and the ink access openings are comprised of a single, circular, circumferential slot formed by the baffle plate that is smaller in diameter than the diameter of the ink cup and fits circumferentially within the diameter of said ink cup.

* * * * *